US005418278A

United States Patent [19]

Ritter et al.

[11] Patent Number: 5,418,278

[45] Date of Patent: May 23, 1995

[54] AQUEOUS EMULSION COPOLYMERS, MORE ESPECIALLY IN WATER-AND OIL-DILUTABLE FORM, FOR IMPROVING THE FLOW PROPERTIES AND POUR POINT DEPRESSION OF CRUDE OILS AND PETROLEUM FRACTIONS AND THEIR USE

[75] Inventors: Wolfgang Ritter, Haan; Claus-Peter Herold, Mettmann, both of Germany

[73] Assignee: Henkel Kommanditgesellschaft auf Aktien, Duesseldorf, Germany

[21] Appl. No.: 655,464

[22] PCT Filed: Sep. 1, 1989

[86] PCT No.: PCT/EP89/01024

§ 371 Date: May 10, 1991

§ 102(e) Date: May 10, 1991

[87] PCT Pub. No.: WO90/02766

PCT Pub. Date: Mar. 22, 1990

[30] Foreign Application Priority Data

Sep. 10, 1988 [DE] Germany ..... 38 30 913.0

[51] Int. Cl.[6] ..... C08L 33/00

[52] U.S. Cl. ..... 524/556; 524/549; 524/567; 524/833

[58] Field of Search ..... 524/556, 561, 833, 549

[56] References Cited

U.S. PATENT DOCUMENTS

| | | | |
|---|---|---|---|
| 3,316,200 | 4/1967 | Hatala | 260/29.6 |
| 4,002,436 | 1/1977 | Wilfrid et al. | 44/62 |
| 4,322,328 | 3/1982 | Graetz et al. | 524/833 |
| 4,521,494 | 6/1985 | Mani | 524/561 X |
| 4,535,098 | 8/1985 | Evani et al. | 521/149 |
| 5,039,432 | 8/1991 | Ritter | 252/8.3 |

FOREIGN PATENT DOCUMENTS

| | | | |
|---|---|---|---|
| 1942504 | 3/1970 | Germany . | |
| 2062023 | 6/1971 | Germany . | |
| 2047448 | 3/1972 | Germany . | |
| 2210431 | 1/1973 | Germany . | |
| 2264328 | 11/1973 | Germany . | |
| 2330232 | 1/1974 | Germany . | |
| 2612757 | 9/1977 | Germany . | |
| 3031900 | 5/1982 | Germany . | |
| 3807394 | 9/1989 | Germany . | |
| 3807395 | 9/1989 | Germany . | |
| 0071747 | 5/1980 | Japan | 524/833 |
| 895086 | 5/1962 | United Kingdom . | |

OTHER PUBLICATIONS

Houben-Weyl, "Methoden der Organischen Chemie", 4th ed., 1959, vol. 1, Part 2, pp. 109/110.

Houben-Weyl, "Methoden der Organischen Chemie", 4th ed. 1959, vol. 1, Part 2, pp. 113–115.

Houben-Weyl, "Methoden der Organischen Chemie", 4th ed. 1959, vol. 1, Part 2, pp. 129–136.

Ullmanns Enzyklopädie der technischen Chemie, 4th ed., vol. 19, pp. 132–145.

*Primary Examiner*—Judy M. Reddick

*Attorney, Agent, or Firm*—Ernest G. Szoke; Wayne C. Jaeschke; Henry E. Millson, Jr.

[57] ABSTRACT

The invention relates to aqueous emulsion copolymers of (meth)acrylates of long-chain alcohols in continuous aqueous phase, characterized in that they contain as storable disperse phase copolymers of the following monomer components:

at least 50% by weight and preferably at least 60% by weight (meth)acrylates of $C_{16-30}$ alcohols 0 to 25% by weight and preferably 5 to 10% by weight (meth)acrylates of alcohols containing no more than 8 carbon atoms 0.5 to 40% by weight and preferably 1 to 25% by weight olefinically unsaturated mono- and/or dicarboxylic acids or anhydrides containing more than 10 carbon atoms.

The invention also relates to the use of these aqueous emulsion copolymers for depressing the pour or flow points of hydrocarbon mixtures, particularly crude oil or petroleum fractions, the described copolymers forming the disperse phase of aqueous emulsion copolymers in a highly concentrated, but readily mobile formulation for incorporation in hydrocarbon mixtures of the described type.

6 Claims, No Drawings

AQUEOUS EMULSION COPOLYMERS, MORE ESPECIALLY IN WATER-AND OIL-DILUTABLE FORM, FOR IMPROVING THE FLOW PROPERTIES AND POUR POINT DEPRESSION OF CRUDE OILS AND PETROLEUM FRACTIONS AND THEIR USE

It is known that the flow properties of crude oils and/or petroleum fractions can be improved by the use of limited quantities of synthetic flow aids. It is known that the function of flow aids is to lower the particular temperature below which solid constituents present in the liquid hydrocarbon mixture, more especially higher paraffins and/or asphaltenes, crystallize out in such quantities that the flowability of the hydrocarbon mixtures is permanently impaired. The temperature range in question is determined by the known methods for determining flow point or pour point. Commensurate with its specific composition, each crude oil or the petroleum fractions obtained therefrom has its own particular flow point which, in the case of the oil pools presently regarded as worth developing, is generally below about 20° C. and, for example, shows values in the range from about 10° to 18° C. Even in this case, it can be advisable in practice to use flow aids based on various synthetic homopolymers and/or copolymers.

There is extensive prior art on auxiliaries of the type in question which are also known as crystallization inhibitors and which are generally obtained by polymerization of olefinically unsaturated compounds containing at least partly unbranched saturated hydrocarbon chains with at least 18 carbon atoms, cf. for example DE-AS 22 10 431 and DE-OSS 26 12 757, 22 64 328, 20 62 023, 23 30 232, 19 42 504 and 20 47 448.

Particular difficulties arise in practice when the flow point of the particular crude oil or petroleum fraction to be processed assumes extremely high values which, in particular, may reach at least 25° C. or even 30° C. and higher. Petroleum materials of this type tend to solidify rapidly, even at ambient temperature. If, for example, pumping operations are interrupted only briefly or if relatively low temperatures are encountered during transport, for example through offshore pipelines, the hydrocarbon material solidifies rapidly into a mass which can no longer be pumped, thereby blocking pipelines, pumps and the like. The situation is complicated by the fact that, in order safely to rule out problems of the type described above, it is often stipulated in practice that the flow points of the oils or oil fractions should be lowered to values below 15° C. and, more particularly, to values below 12° C. or even to values below 10° C. It will readily be appreciated that technological difficulties of a very special nature arise when, for example, the flow point of a particular crude oil has to be lowered from around 33° C. to values distinctly below 10° C. Another difficulty in this regard is that, in general, it is not possible simply by increasing the quantity of flow promoter added to obtain a corresponding reduction in flow point. Hitherto unresolved interactions between the flow aid and the solidifying constituents of the crude oil are presumably responsible in the sense of a threshold effect for the desired objective, the particular constitution of the flow aid being crucially important to its effectiveness.

In DE-PS (German Patent) No. 3,031,900, copolymers of n-alkylacrylates with at least 16 C atoms in the alcohol residue and maleic anhydride, with n-alkylacrylate/maleic anhydride molar ratios of 20:1 to 1:10 are described. Compounds of this type are intended for use as crystallization inhibitors for paraffin-containing crude oils. Numerically presented examples pertain to the use of corresponding copolymers in a molar ratio of 1:1 to 8:1. Crude oils with inherent pour points below 20C are predominantly used. One table of values deals with India crude oil, which is known to be a particularly paraffin-rich starting material (interfering paraffin content 15%), and an inherent pour point of 33C. The optimal efficacy of the copolymers used in this document in terms of pour point lowering on this starting material may be found at an acrylic acid ester/maleic anhydride ratio of 4:1. The lowest pour points established here fall in the range of 12C.

The object of each of the earlier applications of the applicant, DE 3,807,395 and 3,807,394, is the use of selected copolymers of the acrylic and/or methacrylic acid ester types as flow enhancers in paraffin-rich petroleums and petroleum fractions. In the first-mentioned application, the use of copolymers produced from acrylic and/or methacrylic acid esters of higher alcohols or alcohol cuts with at least 16 C atoms in the alcohol residue and no more than 20 wt %, preferably about 0.5–15 wt % free acrylic and/or methacrylic acid—wt % based on copolymer weight—as an additive for crude oil and petroleum fractions containing paraffins and or asphaltenes to lower their flow or set point and improve their flow properties, especially in the temperature range shortly above the set point. The flow enhancers are preferably in paraffin-rich oils or oil fractions with inherent pour points above 20° C. and enable these flow points to be reduced to values below 15° C. and, more particularly, to values below 10° C.

The second of the above-mentioned applications describes the use of copolymers of acrylates and/or methacrylates of higher alcohols or alcohol cuts containing at least 16 carbon atoms in the alcohol radical and no more than 5% by weight and preferably from 0.5 to 2.5% by weight maleic anhydride as flow promoters in paraffin-rich crude oils and/or petroleum fractions having flow points above 25° C. for reducing their flow points to values below 15° C. and preferably to values below 10° C.

It is known that the flow promoters from the cited prior art and from applicants' earlier applications are used in concentrations in the ppm range, for example in concentrations of from 20 to 1,000 ppm and preferably in concentrations of from about 100 to 500 ppm. It is also known that the homogeneous distribution of these extremely low concentrations of additives is crucial to the effectiveness of the copolymers used. In practice, therefore, these flow promoters are used in solution in suitable organic solvents which provide for immediate molecular dispersion of the polymer molecules in the hydrocarbon fractions to be treated and for their interaction with the troublesome components thereof, particularly higher paraffins and/or naphthenes. Particulars of suitable solvents can be found in the relevant prior art, for example in DE-PS 30 31 900 cited at the beginning.

The teaching of the invention described in the following is based on a particular difficulty which acrylate or methacrylate copolymers—hereinafter referred to as (meth)acrylate copolymers—present where they are used via oil-soluble solvents when the (meth)acrylate component of these copolymers contains at least considerable amounts of, or even predominantly, residues of relatively long chain alcohols. In the present context, relatively long chain alcohols are understood in particular to be those having a chain length in the range from about $C_{16}$ to $C_{30}$ and more especially those having a chain length of at least $C_{18}$, particularly when considerable quantities, for example at least about 25% by weight, of alcohols containing at least 20 carbon atoms are present.

(Meth)acrylate copolymers of this type are particularly effective when used as flow point promoters or pour point or flow point depressants. Accordingly, it is desirable in principle for the content of (meth)acrylate components containing such long-chain alcohol radicals to be as high as possible. However, this involves another applicational problem: the longer the alcohol radical in the (meth)acrylate component becomes, the higher the pour point of the (meth)acrylate copolymer in the solvent used will become, giving rise to difficulties in the practical handling and, in particular, in the dosing under in-use conditions of concentrates of the type in question dissolved in organic solvents. At the present time, experts can only circumvent these difficulties by providing and using the flow promoters in comparatively lower concentrations in the solvent and/or by using considerable amounts of comparatively lower alcohols, particularly in the $C_{12-16}$ range, in the production of the (meth)acrylate copolymers. It can be seen that there are limitations and disadvantages to both measures.

The solution proposed by the present invention for overcoming the problem described in the foregoing follows a totally new route from the practical point of view. The teaching according to the present invention is based on the surprising observation that the effective use of flow promoters of the described type does not require preliminary dissolution of the polymeric (meth-)acrylate copolymer compound in an organic solvent, instead it is possible, particularly under the measures described in the following in connection with the invention, to use the copolymers in a totally different formulation. According to the invention, the polymeric active substances are used in the form of aqueous emulsion copolymers.

In a first embodiment, therefore, the present invention relates to the use of pour-point- or flow-point-depressing copolymers of (meth)acrylates of long chain alcohols and ethylenically unsaturated mono- and/or dicarboxylic acids containing up to 10 carbon atoms or anhydrides thereof and, if desired, limited quantities of (meth)acrylates of short-chain alcohols in the form of the disperse phase of aqueous emulsion copolymers as a highly concentrated, but readily mobile formulation for incorporation in hydrocarbon mixtures, particularly in crude oil or petroleum fractions.

In another embodiment, the invention relates to water-dilutable and oil-dilutable, mobile aqueous emulsion copolymers of copolymers of (meth)acrylates of higher alcohols containing up to about 30 carbon atoms and ethylenically unsaturated mono- and/or dicarboxylic acids or anhydrides thereof containing up to 10 carbon atoms and, if desired, limited quantities of (meth)acrylates of short-chain alcohols containing as principal components about 20 to 70% by weight and preferably about 30 to 50% by weight disperse copolymer phase, about 0.1 to 7% by weight and preferably about 0.5 to 5% by weight oil-in-water emulsifiers, up to about 35% by weight water- and oil-soluble solubilizers and/or up to about 7% by weight water-in-oil emulsifiers and water as continuous phase.

Taking into account the hitherto common practice of always adding flow-promoting and pour-point-depressing polymers of the type in question here in predissolved form, i.e. predissolved in an organic solvent, such as toluene, to the crude oils, petroleum fractions or other hydrocarbon mixtures to be treated, the procedure according to the invention and the comparable or even better results obtained in relation to the prior art are entirely unusual. If it is considered that the additives are used in ppm concentrations, based on the hydrocarbon material to be treated, and that the effectiveness of these compounds depends on an unknown interaction with the troublesome components, particularly the higher paraffins and/or naphthenes, it seems logical and necessary to introduce the flow-promoting and pour-point-depressing polymer compounds in activated form into the hydrocarbon material to be treated. This is not the case in the context of the teaching according to the invention. In this case, the polymer compounds are present as a disperse, substantially solvent-free, optionally at least partly solidified organic phase in the homogeneous aqueous phase. When aqueous emulsion polymers of this type are mixed with the hydrocarbon mixture to be treated, the polymer compound initially has to undergo a phase inversion. It has to pass from the disperse aqueous phase into the continuous organic phase in which it has to dissolve and hence undergo the activation step before finally interacting with the components responsible for the high pour and flow points. The teaching according to the invention is based on the one hand on the unexpected discovery that the desired effect occurs in the hydrocarbon material to be treated even and precisely when the flow pomoters are used in the described form of the emulsion copolymers.

So far as the invention is concerned, however, this affords further practical advantages which make up the other part of the concept according to the invention:

If the copolymeric active substance is provided and used in the form of an aqueous emulsion copolymer, the flowability of the active substance in practical application will depend upon the particular constitution of the copolymer and, to a very large extent, upon its concentration in the mixture of aqueous/organic active substances. The viscosity of aqueous emulsion polymers may be controlled in known manner in such a way as to guarantee high flowability at low viscosities and high solids concentrations. So far as the (meth)acrylic copolymer is concerned, this means above all that it is now safely possible to use (meth) acrylates with, in particular, long-chain alcohols which give optimal results in regard to pour point and flow point depression without the particular pour points of these auxiliaries in organic solvents having to be taken into consideration, as was essential in the prior art. At the same time, these copolymers predominantly or even exclusively based on (meth)acrylates with higher alcohols may be used in high concentrations in practice.

In one preferred embodiment of the invention, the necessary phase reversal during mixing of the aqueous emulsion copolymers with the hydrocarbon mixtures to be treated, particularly crude oil or petroleum fractions, is facilitated and/or accelerated by the co-use of selected mixture components in the aqueous emulsion copolymers.

A first embodiment in this regard is characterized by the use of aqueous emulsion copolymers of the described type to which additional components distinguished both by solubility in or miscibility with water and by solubility in or miscibility with oils have been added. Preferred examples of such components are polyfunctional alcohols and/or ethers distinguished by their compatibility on the one hand with water and, on the other hand, with hydrocarbon phases. Typical examples of compounds of this type are ethylene glycol, its partial ethers with, in particular, lower monofunctional alcohols and also polyethylene glycols which may even be at least partly etherified. Further examples are the propanediols, although glycerol is particularly preferred. Corresponding polyfunctional alcohols and/or ethers or partial ethers containing an even larger number of carbon atoms are also suitable. Other components, for example selected ketones distinguished by miscibility with water and oils, may also be used in addition to or instead of the compounds mentioned above.

Solubilizers of the type mentioned above are preferably used in quantities of up to about 35% by weight, based on aqueous emulsion copolymer, more preferably in quantities of at least about 5% by weight and, most preferably, in quantities of at least about 10 to 20% by weight.

In a second embodiment, the phase reversal process in question is promoted by the addition of water-in-oil emulsifiers to the aqueous emulsion copolymers. This addition is preferably made after the preparation of the aqueous emulsion copolymers. The w/o-emulsifiers may be used in addition to or instead of the water- and oil-miscible compounds of the type mentioned above. The w/o emulsifiers used are normally added in quantities of up to about 5% by weight, again based on the aqueous emulsion copolymer. Typical examples of such w/o emulsifiers are the representatives of this known class of compounds which are described in HOUBEN-WEYL, Methoden der organischen Chemie, 4th Edition 1959, Vol. I, Part 2, 109/110 and also 113 et seq., cf. in particular the Table on pages 129 to 136.

The aqueous emulsion copolymers used in accordance with the invention may basically have viscosities in a wide range. Since the viscosity of these copolymers may be determined inter alia by the solids concentration, another possibility of variation is thus available. However, so far as the operation of mixing of the aqueous emulsion copolymer with reversal of its disperse phase and dissolution in the hydrocarbon mixtures to be treated is concerned, it is of advantage to use materials which are distinguished by comparatively low viscosity values. These low viscosity values may exist as such in the aqueous emulsion copolymer, although if desired they may also be established by dilution of relatively high-viscosity aqueous emulsion copolymers with water and/or an aqueous/organic phase of water and auxiliary solvent, for example of the above-described type of polyfunctional alcohols and/or ethers thereof. Viscosity values of the aqueous emulsion copolymers of at most about 10,000 mPa.s are preferred for processing, viscosity values not exceeding about 5,000 mPa.s being particularly preferred. Materials of which the flowability approaches that of water, i.e. for example materials having viscosity values in the range from about 100 to 3,000 mPa.s, are particularly suitable. All the viscosity values cited here are Brookfield viscosities (RTV, 20° C., 20 r.p.m.).

(Meth)acrylate copolymers of the described type, in which the alcohol radicals are predominantly or exclusively long-chain alcohol radicals having preferred chain lengths of at least $C_{16}$ and preferably of at least $C_{20}$, are particularly suitable for the teaching of the invention. At least 50 mol-% and preferably at least 80 mol-% of radicals of this type are present in the long-chain alcohol mixtures normally used for the preparation of this monomer component. Preferably, these alcohols or alcohol radicals are predominantly corresponding compounds containing n-alkyl radicals. The alcohols themselves may be of natural and/or synthetic origin. Corresponding alcohol fractions of natural origin are, for example, fractions predominantly containing behenyl alcohol.

The co-use of acrylic acid and/or methacrylic acid or the other monocarboxylic acids having C-chains of the above mentioned length and/or the co-use of corresponding dicarboxylic acids or anhydrides thereof leads to particularly effective copolymers when comparatively high contents of alcohol radicals containing at least 22 carbon atoms are present in the (meth)acrylate copolymer. Thus, it can be of advantage in accordance with the invention to use alcohol cuts of which the $C_{22}$ alcohol content is at least about 25% by weight, preferably at least about 35% by weight and, more preferably, at least 45% by weight for the production of the acrylate components. Particularly good flow point promoters are obtained when these long-chain alcohol components are present in quantities of more than 50% by weight in the alcohol cuts used for the production of the (meth)acrylate component. The percentages by weight are based on the content of $C_{22}$ alcohols and, optionally, higher alcohols in the alcohol mixture which has been used for the production of the (meth)acrylate components.

Particularly suitable comonomers for the emulsion copolymerization with the (meth)acrylates of the described type are mono- and/or dicarboxylic acids or anhydrides thereof containing up to 6 carbon atoms. Particularly preferred examples are acrylic acid, methacrylic acid, crotonic acid, itaconic acid, maleic acid, maleic anhydride and/or fumaric acid.

Particularly suitable (meth)acrylate copolymers contain the mono- and/or dicarboxylic acids or anhydrides thereof used as comonomers in quantities of up to about 50% by weight and, preferably, in quantities of up to about 40% by weight. The most advantageous quantities may be co-determined by considerations relating to the stability of the aqueous emulsion copolymers formed, although in this case general knowledge of emulsion copolymerization also has to be taken into account in this regard and applied to the process used to prepare the active substance mixtures used in accordance with the invention.

It has been found that the production of low-coagulate, storable, aqueous emulsion copolymers of the type in question here with high contents of (meth)acrylates of long-chain alcohols is more difficult, the higher on the one hand the content of long-chain alcohol radicals bound in the copolymer molecule and the longer on the other hand the alcohol radicals in question. Accordingly, stability problems can arise in particular when, for example in the context of the problem to be solved by the invention, long-chain alcohols ($C_{22}$ and longer) are to be incorporated in high concentrations in the copolymer molecule. Standard o/w emulsifiers may not have a sufficient stabilizing effect to guarantee the stable dispersion state required. However, assistance is available in the class of copolymers selected in accordance with the invention simply in the fact that the described mono- and/or dicarboxylic acids or anhydrides thereof are used as comonomers. The use of precisely this class of comonomers leads to additional stabilization of the disperse organic phase formed during the emulsion copolymerization. Depending on the composition of the multicomponent mixture used, however, it may be necessary to use comparatively larger quantities of the carboxylic acid components. This applies in particular when monocarboxylic acids are exclusively used as comonomers. If the dispersion stability additionally required is to be established through their co-use, it may be necessary to use comparatively larger quantities, for example 20 to 40% by weight of monocarboxylic acid, based on the total weight of the organic components to be polymerized. Dicarboxylic acids and/or anhydrides thereof as comonomers may be used in comparatively smaller quantities, for example in quantities of from about 5 to 20% by weight, based on the total weight of the organic components to be polymerized, and even in these quantities show considerable stabilizing effects, even in cases where large proportions of particularly long-chain alcohol radicals are used in the copolymer molecule.

The above-described linking of dispersion stability to the co-use of, after all, considerable minimum quantities of mono- and/or dicarboxylic acids or anhydrides thereof can lead to a limitation in the free choice of the copolymer composition solely from the standpoint of optimal effectiveness in improving the flow properties or depressing the pour point and flow point of the mixtures to be treated.

Another embodiment of the invention provides effective assistance in this regard. It has been found that the problems of inadequate emulsion or dispersion stability of the organic copolymer phase are substantially reduced when, in addition to the comonomer components discussed thus far, a third class of compounds is used in comparatively small quantities in the copolymerization. The compounds in question are (meth)acrylates of short-chain alcohols. The alcohol component of these comonomers preferably has at most 8 carbon atoms and, in particular, is limited to 4 carbon atoms. Typical examples of compounds of this type are ethyl and/or butyl (meth)acrylate. These (meth)acrylates of short-chain alcohols are used in quantities of at most 25% by weight, preferably in quantities not exceeding 20% by weight and more preferably in quantities not exceeding 15% by weight, based in each case on comonomer mixture. Effective stabilizing effects, despite a considerable reduction in the content of mono- and/or dicarboxylic acids or anhydrides thereof in the copolymer molecule, are obtained even when the quantity of these lower (meth)acrylates is in the range from about 5 to 10% by weight (based on the weight of the copolymer).

This stabilization of the described copolymers based on (meth)acrylates of long-chain alcohols with a large number of carbon atoms in the alcohol radical and a high concentration of this component in the copolymer molecule in aqueous dispersion copolymers represents part of the present invention which may even be regarded separately from the specific application covered by the foregoing description of the invention.

In another embodiment, therefore, the present invention relates to stabilized aqueous emulsion copolymers of (meth)acrylates of long-chain alcohols in continuous aqueous phase, characterized in that the emulsion copolymers in question contain copolymers of the following monomer components as storable disperse phase:

at least 50% by weight and preferably at least 60% by weight (meth)acrylates of $C_{16-30}$ alcohols up to 25% by weight and preferably from 5 to 10% by weight (meth)acrylates of alcohols containing no more than 8 C atoms and 0.5 to 40% by weight and preferably about 1 to 25% by weight olefinically unsaturated mono- and/or dicarboxylic acids or anhydrides thereof preferably containing no more than 10 C atoms.

Particularly preferred aqueous emulsion copolymers are those which contain no more than about 10% by weight (meth)acrylates of short-chain alcohols, 0.1 to 15% by weight and more especially about 1 to 10% by weight of the mono- and/or dicarboxylic acids or anhydrides thereof and, for the rest, the (meth)acrylates of the long-chain alcohols as disperse organic phase in the aqueous emulsion copolymer. For the rest, the general numerical data provided in the foregoing apply to the particularly preferred composition of the copolymers or rather their respective components.

Through the use of aqueous copolymers in the embodiment just described, it is possible to achieve substantially optimal adaptation of the structure of the copolymer molecule even to the requirements of optimal pour or flow point depression.

The special composition of the particular copolymer types is determined in particular by their effectiveness in improving the flow behavior of the particular hydrocarbon mixture as represented in particular by crude oil or a petroleum fraction. However, it is often very difficult to make safe predictions regarding the optimal quantities of acrylate ester and acidic comonomer to be used in each individual case. The optimal mixing ratios should therefore be determined from case to case on the basis of the hydrocarbon mixture to be treated. The reason for this would appear to lie in the fact that the particular compositions of the crude oils or petroleum fractions of different origin differ considerably from one another and that the mechanism responsible for pour point depression and hence for the improvement in flow properties has not yet been fully elucidated. As mentioned at the beginning, it is assumed that the copolymers added in ppm concentrations become active in the sense of a threshold effect in the treated hydrocarbon material, more especially by interaction with naphthenes and/or higher troublesome paraffin components. The formulation selected in accordance with the invention for the aqueous emulsion copolymers now makes it possible for the first time to achieve substantially problem-free optimization in the structure of the disperse copolymer phase and adaptation thereof to the particular natural conditions prevailing.

So far as the preferred quantities of, for example, acrylic acid and/or methacrylic acid in the copolymer are concerned, a broad range of, for example, from about 1 to 40% by weight, based on the weight of the copolymer, is suitable. Taking emulsion stability into account, particular significance may be attributed to quantities in the higher part of this range, for example quantities of from about 15 to 40% by weight and, in particular, quantities of from 20 to about 35% by weight of the monocarboxylic acid(s). On the other hand, it may be desirable for optimal effectiveness in pour point depression and flow improvement to incorporate comparatively smaller quantities of the monocarboxylic acids in the copolymer, for example quantities of from about 1 to 25% by weight and, more particularly, quantities of from about 5 to 15% by weight, based in each case on the weight of the copolymer.

Where dicarboxylic acids or dicarboxylic acid anhydrides of the maleic anhydride type are used, it may be appropriate to limit comonomers such as these to quantities of at most about 20% by weight and preferably to quantities of no more than 10% by weight. Maleic anhydride may be processed, for example, in quantities of from about 5 to 10% by weight, based on the weight of the copolymer, to very stable emulsion copolymers which, at the same time, have an optimal effect in depressing the flow and pour points.

In one particular embodiment, it may be desirable to take the disclosures of the above-cited earlier applications P 38 07 395.1 (D 8141) and P 38 07 394.3 (D 8142) into consideration with regard to the composition of the (meth)acrylate copolymers. For these embodiments, therefore, the following observations apply to the composition of the copolymers:

Particularly suitable copolymers contain, together with the acrylates and/or methacrylates of higher alcohols or alcohol cuts, approximately 0.5 to 15% by weight of the free monocarboxylic acids mentioned, copolymers of the described type containing approximately 1 to 10% by weight free acid being particularly suitable. The most important copolymers of the type used in accordance with the invention contain acrylic acid and/or methacrylic acid as comonomers in the above-described copolymers in quantities of from about 1.5 to 5.0% by weight. All these percentages by weight are based on the weight of the copolymer.

Another preferred embodiment of the invention is characterized by the use of copolymers of acrylates and/or methacrylates of higher alcohols or alcohol cuts containing at least 16 carbon atoms in the alcohol radical and no more than 5% by weight maleic anhydride, based on the weight of the copolymer. Copolymers of the type mentioned, which contain about 0.5 to 2.5% by weight and, more particularly, about 1 to 2% by weight maleic anhydride, are particularly suitable for the purposes of the invention. Once again, the percentages by weight are based on the weight of the copolymer.

It is part of the teaching according to the invention to adjust the flow points of the crude oils and/or petroleum fractions used with their starting flow points above 25° C. and, in particular, above 30° C. to values below 15° C. and preferably to values below 10° C. by the addition of the flow promoters defined in accordance with the invention. According to the invention, it is possible for example to achieve flow points in the range from about 0° to 10° C. by addition of conventional quantities of the flow promoters according to the invention. In this way, even these crude oils or petroleum fractions may be handled without interruption under normal everyday conditions. More particularly, underwater pipelines, distributors and the like can be operated without interruption.

The in-use concentration of the flow promoters according to the invention is in the conventional range, for example in the range from 20 to 1,000 ppm, concentrations in the range from 100 to 500 ppm being preferred.

The emulsion copolymerization is carried out in known manner, cf. for example Ulmanns Enzyklopädie der technischen Chemie, 4th Edition, Vol. 19, 132 to 145.

Limited quantities of oil-in-water emulsifiers are used for the preparation and stabilization of the disperse polymer phase in the continuous aqueous phase. Suitable emulsifiers of this type are, in particular, anionic or nonionic emulsifiers or mixtures thereof. Thus, it is possible for example to use sulfates or sulfonates of long-chain alcohols or alkylphenols and also alkyl benzenesulfonates or sulfosuccinates. The sulfates of reaction products of ethylene oxide and (fatty) alcohols or alkylphenols are also suitable, the starting materials preferably being nonionic emulsifiers. Other nonionic emulsifiers are sorbitan esters of long-chain fatty acids, ethoxylated sorbitan esters of long-chain fatty acids and/or alkyl glycerides. The emulsifiers may typically be used in quantities of from about 0.01 to 5% by weight and preferably in quantities of from about 0.1 to 3% by weight, based in either case on the weight of the monomers. Suitable free radical initiators are the usual peroxide compounds, for example inorganic persulfate compounds, such as alkali or ammonium persulfate, hydrogen peroxide, organic hydroperoxides, for example benzoyl peroxide, acetyl peroxide, per acids, such as peracetic acid and perbenzoic acid, or even other materials yielding free radicals, such as 2,2'-azo-bis-isobutyronitrile. Other auxiliaries such as buffers, inorganic salts and pH regulators may also be used for the emulsion polymerization.

The copolymerization is typically carried out at temperatures in the range from about 60° to 90° C., although it may also be carried out at higher or lower temperatures.

EXAMPLES

1. General Manufacturing Procedure for Producing Dispersions Based on Poly(behenacrylate-co-maleic acid)

Apparatus

The reaction is performed in a standard laboratory apparatus consisting of a double-walled glass reactor, agitator, reflux cooler, and heated dropping funnel.

| Raw Materials | |
|---|---|
| C16/18-behenyl acrylate*) | 810 9 |
| Maltic anhydride | 90 g |
| Dehydrophen(R) 100*) | 100 g |
| (NH4)2S208 | 1 g |
| Water, dist. | 1000 g |

*)See information in Table 1)

PROCEDURE 828 g distilled water, 100 g Dehydrophen 100(R), and 90 g maleic anhydride are placed in a reactor and heated to BS-90C within 60 min. 243 g molten behenyl acrylate (50C) are added and emulsified for 15 min at an agitator speed of 140 rpm. At this time, 0.4 g ammonium peroxodisulfate dissolved in 10 g water are added all at once.

Exactly 15 min after this addition, a. an initiator solution consisting of 0.4 g ammonium peroxydisulfate in 160 g water and b. the monomer melt consisting of 567 g behenyl acrylate are added at constant rates from two separate metering funnels over a period of 30 minutes at a temperature of 50° C.

30 Minutes after the complete addition of monomer and initiator, 0.2 g ammonium peroxodisulfate dissolved in 2 g water is added in one portion as post-initiator.

The after-reaction time is 90 minutes.

After the product has been cooled to 20° C., the dispersion is filtered through a filter bag (80 μm) and packed.

The filter sack is washed out and, after drying, the coagulate found is expressed as %-residue, based on total monomer.

The stirring speed during the reaction is 140 r.p.m.

The properties of the dispersion are shown in Table 1 (Example 1). Examples 2 to 11 were carried out in the same way.

TABLE 1

Overview of aqueous dispersions of poly(behenyl acrylate-co-maleic acid)

| Example | Mixture: Water g | BA[2] g | MAH[3] g | EM[4] g | Initiator[5] g | Glycerol g |
|---|---|---|---|---|---|---|
| 1 | 1000 | 810.0 | 90.0 | 100 | 1.0 | — |
| 2 | 600 | 339.5 | 10.5 | 50 | 0.5 | — |
| 3 | 500 | 427.5 | 22.5 | 50 | 0.5 | — |
| 4 | 500 | 418.5 | 31.5 | 50 | 0.5 | — |
| 5 | 400 | 418.5 | 31.5 | 50 | 0.5 | 100 |
| 6 | 500 | 405.0 | 45.0 | 50 | 0.5 | — |
| 7 | 300 | 495.0 | 55.0 | 50 | 0.5 | 100 |
| 8 | 500 | 405.0 | 45.0 | 50 | 0.5 | — |
| 9 | 677 | 286.4 | 71.6 | 38 | 0.5 | — |
| 10 | 500 | 360.0 | 90.0 | 50 | 0.5 | — |
| 11 | 600 | 150.0 | 200.0 | 50 | 0.5 | — |

| Example | Properties: S[1] % | coagulate content % by weight | Stability of the dispersion after storage at room temperature | Brookfield viscosity at 20°C. mPa·s | at min.$^{-1}$ |
|---|---|---|---|---|---|
| 1 | 50 | 0.2 | >218 | 64 | 100 |
| 2 | 50 | 100.0 | nil | — | — |
| 3 | 50 | 34.9 | >432 | — | — |
| 4 | 50 | 0.5 | >197 | 100 | 100 |
| 5 | 50 | 100.0 | nil | — | — |
| 6 | 50 | 0.2 | >465 | 60 | 100 |
| 7 | 50 | 1.4 | >453 | 520 | 20 |
| 8 | 50 | 0.9 | >32 | 80 | 100 |
| 9 | 50 | 100.0 | nil | — | — |
| 10 | 50 | 3.8 | >429 | — | — |
| 11 | 50 | — | 481 | 28 | 100 |

[1]FK = Solids content of the dispersion

[2]BA = Behenyl acrylate: In examples 1-7 and 9-11, behenyl acrylate A was used, and in example 8, behenyl acrylate B, with the following C-chain distribution:

| | C—chain distribution of the fatty alcohol/% | | | |
|---|---|---|---|---|
| | C16 | C18 | C20 | C22 |
| Behenyl acrylate A | 16.3 | 22.9 | 10.7 | 46.9 |
| Behenyl acrylate B | 1.5 | 8.6 | 15.2 | 68.8 |

[3]MAM = Maleic anhydride

[4]EM = Emulsifier (Dehydrophen(R) 100) nonylphenol with ca. 10 moles EO from Henkel KGaA Dusseldorf

[5]Initiator = Anmonium peroxodisulfate

2. General Manufacturing Procedure for Producing Dispersions Based on Poly(behenyl acrylate-co-acrylic acid)

APPARATUS

The reaction is performed in a standard laboratory apparatus consisting of a double-walled glass reactor, agitator, reflux cooler, and heated dropping funnel.

| Raw Materials | |
|---|---|
| C16/18-behenyl acrylate*) | 280 g |
| Acrylic acid | 70 g |
| Dehydrophen(R) 100*) | 25 g |
| (NH4)2S208 | 0.5 g |
| Water, dist. | 600 g |

*)See information in Table 1)

PROCEDURE 514 g distilled Hater, 25 g Dehydrophen(R) 100 and 25 g Texapon(R) N 25 are placed in a reactor and heated to 85–90C within 60 min. 280 g molten behenyl acrylate (50 C) and 70 g acrylic acid are mixed, and 30 wt % of this mixture are emulsified for 15 min at an agitator speed of 140 rpm. At this time, 0.2 g ammonium peroxodisulfate, dissolved in 5 g water, are added all at once.

Exactly 15 min after this addition, a. an initiator solution consisting of 0.2 ammonium peroxodisulfate in 180 g water and b. the remaining 70 wt % of the monomer salt comprising behenyl acrylate and acrylic acid at 50C are added from two separate dispensing funnels within 30 min at a constant dispensing rate.

30 min after addition of all the monomer and initiator 0.1 g ammonium peroxodisulfate in 19 water are added all at once as post-initiator.

The post-reaction time is 90 min. Then they are cooled.

The agitator speed during the reaction is 140 rpm.

The properties of the dispersion are summarized in Table 2 (Example 18). Examples 12 to 21 were produced by analogous procedures.

TABLE 2

Overview of aqueous dispersions of poly(behenyl acrylate-co-acrylic acid)

| Example | Mixture: Water g | Monomers: BA[1] g | AS[2] g | BuA[3] g | EA[4] g | Emulsifiers: Dis[5] g | DP[6] g | TP[7] g | Initiator[8] g | Properties: S[9] % | Coagulate content % by weight | Stability of the dispersion after storage at room temperature days |
|---|---|---|---|---|---|---|---|---|---|---|---|---|
| 2 | 600 | 339.5 | 10.5 | — | — | — | 25 | 25 | 0.5 | 40 | 100 | nil |
| 3 | 600 | 280.0 | 10.5 | — | 59.5 | — | 25 | 25 | 0.5 | 40 | | >213 |
| 4 | 677 | 340.1 | 17.9 | — | — | 35 | — | — | 0.5 | 30 | 100 | nil |
| 5 | 600 | 332.5 | 17.5 | — | — | — | — | 50 | 0.5 | 40 | 100 | nil |
| 6 | 600 | 280.0 | 17.5 | 52.5 | — | — | 25 | 25 | 0.5 | 40 | | >217 |
| 7 | 677 | 286.4 | 71.6 | — | — | 35 | — | — | 0.5 | 30 | 100 | nil |
| 8 | 600 | 280.0 | 70.0 | — | — | — | 25 | 25 | 0.5 | 40 | | >218 |
| 9 | 500 | 360.0 | 90.0 | — | — | — | 50 | — | 0.5 | 50 | 100 | nil |
| 10 | 677 | 250.6 | 107.4 | — | — | 35 | — | — | 0.5 | 30 | | >225 |

TABLE 2-continued

Overview of aqueous dispersions of poly(behenyl acrylate-co-acrylic acid)

| | Mixture | | | | | | | | | | Properties | |
|---|---|---|---|---|---|---|---|---|---|---|---|---|
| | | Monomers | | | | Emulsifiers | | | | | Coagulate | Stability of the dispersion |
| Example | Water g | BA[1] g | AS[2] g | BuA[3] g | EA[4] g | Dis[5] g | DP[6] g | TP[7] g | Initiator[8] g | S[9] % | content % by weight | after storage at room temperature days |
| 11 | 677 | 214.8 | 143.2 | — | — | 35 | — | — | 0.5 | 30 | | >227 |

[1]BA = Behenyl acrylate; Behenyl acrylate with the C-chain distribution as in Table 1 was used.
[2]AS = Acrylic acid
[3]BuA = Butyl acrylate
[4]EA = Ethyl acrylate
[5]Dis = 1:1 mixture of Disponil(R) SUS 90 (sodium alkyl acryl-EO-sulfosuccinate) and Disponil(R) FES 92 (sodium alkyl other sulfate)
[6]DP = Dehydrophen(R) 100 (nonylphonol with ca. 10 noles EO)
[7]TP = Texapon(R) N 25 (sodium lauryl ether sulfate)
All emulsifiers are products of Henkel KGaA, Dusseldorf
[8]Initiator = Ammonium peroxodisulfate
[9]FK = Solids content of the dispersion 3. Transfer of the Polymers Dispersed in Water into Organic Medium Into the dispersion in accordance with Example 1, the following alcohols are stirred at room temperature (magnetic agitator, mixing time 10 min):

1 a -
1 b Glycerin, 5 wt %
1 c Glycerin, 10 wt %
1 d Propanediol-1,2, 10 wt %

In each case homogeneous mixtures result. In each case, 5 g of the mixture are mixed with 95 g xylene at room temperature, using a magnetic agitator (mixing time 10 min). The mixtures are stored until phase separation takes place (1.5–4 hr) and the upper, xylene phase separated with a separatory funnel. The xylene phase is concentrated by evaporation and the remaining polymer is dried in vacuo at 10 mbar/100° C.

The results of the tests are shown in Table 3.

TABLE 3

Phase reversal of dispersed poly(behenyl acrylate-co-maleic acid) particles from the aqueous dispersion to the organic solution

| Test | Emulsification of the dispersion in xylene | Time required for separation h | Polymer recovered in the xylene solution t by-weight |
|---|---|---|---|
| 1 a | poor | 1 | 20 |
| 1 b | moderate | 2 | 38 |
| 1 c | good | 4 | 71 |
| 1 d | good | 4 | 29 |

DETERMINATION OF THE POOR POINTS

The pour points were determined in accordance with ASTM D 97-66 and DIN 51 597.

25.0 Bombay crude were kept for 15 minutes at 50° C. in a closed vessel with 800 ppm of a 50% by weight dispersion of the flow promoter and were shaken vigorously 5 times at regular intervals. The crude oil thus doped was rapidly transferred to a cylindrical glass vessel with an internal diameter of 27 mm which was then immediately closed and suspended at a sufficient depth in a water bath at +36° C.

After 30 minutes, the vessel was inclined slightly to one side and examined to see whether the sample was free-flowing. The sample was then cooled in steps of 3° C. and the test repeated after each step. The pour point was determined by adding 3° C. to the temperature at which the sample ceased to flow, even when the glass vessel was inclined through 90°.

The pour point of the untreated Bombay crude determined by this method is 30° C.

TABLE 4

Pour Points in Bombay crude (°C.)

| Example*) | Pour point (°C.) |
|---|---|
| 1 | 9 |
| 3 | 12 |
| 4 | 12 |
| 5 | 12 |

We claim:

1. A method of reducing the pour-point and flow-point of hydrocarbon mixtures comprising adding thereto a pour-point and flow-point reducing quantity of a water-dilutable and oil-dilutable aqueous emulsion of a copolymer consisting essentially of A. from about 20 to about 70% by weight of at least on copolymers as a disperse phase in the emulsion which is a copolymer consisting of a (meth)acrylic acid ester of a higher alcohol containing from 16 to about 30 carbon atoms and at least one ethylenically unsaturated monocarboxylic acid or anhydride thereof, dicarboxylic acid or anhydride thereof, or a mixture of the foregoing, wherein said acid or anhydride contains up to 10 carbon atoms, and optionally a (meth)acrylic acid ester of a short-chain alcohol containing up to 8 carbon atoms;

B. from about 0.1 to about 7% by weight of at least one oil-in-water emulsifier;

C. from 0 to about 35% by weight of a water soluble and oil soluble solubilizer;

D. from 0 to about 7% by weight of a water-in-oil emulsifier; and

E. water as a continuous phase in the emulsion;

wherein the above percentages by weight are based on the aqueous emulsion.

2. The method of reducing the pour-point and flow-point of hydrocarbon mixtures according to claim 1 wherein in the aqueous emulsion, component A is a copolymer of at least about 50% by weight of (meth)acrylic acid esters of $C_{16-30}$ alcohols, from 0 to about 25% by weight of (meth)acrylic acid esters of alcohols having no more than 8 carbon atoms, and from about 0.5 to about 40% by weight of the ethylenically unsaturated acid component.

3. The method of claim 1 wherein said pour-point and flow-point reducing quantity is from about 20 to about 1,000 ppm.

4. The method of claim 2 wherein said pour-point and flow-point reducing quantity is in the range of from about 100 to about 500 ppm.

5. A mixture of hydrocarbons containing from about 20 to about 1,000 ppm of a water-dilutable and oil-dilutable aqueous emulsion of a copolymer consisting essentially of A. from about 20 to about 70% by weight of at least one copolymer as a disperse phase in the emulsion which is a copolymer consisting of a (meth)acrylic acid ester of a higher alcohol containing from 16 to about 30 carbon atoms and at least one ethylenically unsaturated monocarboxylic acid or anhydride thereof, dicarboxylic acid or anhydride thereof, or a mixture of the foregoing, wherein said acid or anhydride contains up to 10 carbon atoms, and optionally (meth-)acrylic acid ester of a short-chain alcohol containing up to 8 carbon atoms:

B. from about 0.1 to about 7% by weight of at least one oil-in-water emulsifier;

C. from 0 to about 35% by weight of a water soluble and oil soluble solubilizer;

D. from 0 to about 7% by weight of a water-in-oil emulsifier; and

E. water as a continuous phase in the emulsion;

wherein the above percentages by weight are based on the aqueous emulsion.

6. The mixture of hydrocarbons of claim 5 wherein in the aqueous emulsion, component A is a copolymer of at least about 50% by weight of (meth)acrylic acid esters of alcohols, from 0 to about 25% by weight of (meth)acrylic acid esters of alcohols having no more than 8 carbon atoms, and from about 0.5 to about 40% by weight of the ethylenically unsaturated acid component.

* * * * *